US010226080B2

(12) United States Patent
Gethers

(10) Patent No.: US 10,226,080 B2
(45) Date of Patent: Mar. 12, 2019

(54) BIB

(71) Applicant: Nina S. Gethers, Atlanta, GA (US)

(72) Inventor: Nina S. Gethers, Atlanta, GA (US)

( * ) Notice: Subject to any disclaimer, the term of this patent is extended or adjusted under 35 U.S.C. 154(b) by 148 days.

(21) Appl. No.: 15/185,245

(22) Filed: Jun. 17, 2016

(65) Prior Publication Data

US 2017/0000193 A1 Jan. 5, 2017

Related U.S. Application Data

(60) Provisional application No. 62/184,296, filed on Jun. 25, 2015.

(51) Int. Cl.
*A41B 13/00* (2006.01)
*A41B 13/10* (2006.01)

(52) U.S. Cl.
CPC ..... *A41B 13/103* (2013.01)

(58) Field of Classification Search
CPC ..... A41B 13/00; A41B 13/10; A41B 13/103; A41B 13/106; A41D 13/04; A41D 13/1245; A41D 13/0012
USPC ..... 2/46, 48, 49.1, 49.2, 49.3, 49.4, 49.5, 2/174, 50, 51, 102, 247, 248, 916; D2/861–864
See application file for complete search history.

(56) References Cited

U.S. PATENT DOCUMENTS 2,164,369 A * 7/1939 Woolever ..... A41B 13/103 2/49.1
2,174,694 A * 10/1939 Elson ..... A41B 13/103 2/49.2
2,263,538 A * 11/1941 Freirich ..... A41D 13/0012 2/51
3,597,763 A * 8/1971 Bienvenu ..... A41B 13/103 2/49.3
3,654,629 A * 4/1972 Crisman ..... A41B 13/10 2/49.1
4,975,982 A * 12/1990 Hughes ..... A41B 13/10 2/174
5,201,073 A * 4/1993 Spanier ..... A41B 13/103 2/247
5,490,289 A * 2/1996 Lehrer ..... A41B 13/103 2/46
6,128,780 A 10/2000 Reinhart et al.
6,499,140 B1 12/2002 Benjamin et al.
7,143,448 B1 12/2006 Gottehrer
7,269,856 B1 * 9/2007 Cannan ..... A41B 13/10 2/49.1
7,269,857 B2 9/2007 Cymbal
(Continued)

FOREIGN PATENT DOCUMENTS

DE 19715134 A1 * 10/1998 ..... A41D 13/04

*Primary Examiner* — Jameson D Collier
(74) *Attorney, Agent, or Firm* — MacMillan, Sobanski & Todd, LLC

(57) ABSTRACT

A bib has an upper section with two arms, the two arms defining a neck opening. Fasteners may be attached to the bib to secure the two arms together. A lower section includes a protective portion. A first pleat extends across the width of the bib and is attached at the lateral edges of the bib. The top of the first pleat is attached to the upper section. The first pleat extends downwardly to the lower section. Additional pleats, generally parallel to the first pleat, extend the width of the bib below the first pleat. The pleats preferably have a scarf like appearance.

20 Claims, 2 Drawing Sheets

(56) References Cited

U.S. PATENT DOCUMENTS

| | | | | |
|---|---|---|---|---|
| 7,636,949 | B1 * | 12/2009 | Shooshan | A41D 13/0012 2/48 |
| 2012/0047618 | A1 * | 3/2012 | Phillips | A41B 13/106 2/49.2 |

* cited by examiner

BIB

REFERENCE TO RELATED APPLICATIONS

This application claims priority from U.S. Provisional Application Ser. No. 62/184,296, filed Jun. 25, 2015, the disclosures of which are hereby incorporated by reference.

FIELD OF THE INVENTION

The present invention relates to bibs and more particularly to bibs having pleats or pockets for functional and aesthetic proposes.

BACKGROUND OF THE INVENTION

Bibs have long been used for protecting the clothing of the wearer, particularly by infants and children to protect their clothing when eating. Many bibs comprise a flat sheet of material, typically stiff or hard and possibly liquid resistant, that merely deflects food, including liquids, off of the bib and onto the wearer's lap or clothing. To prevent this, some bibs have included pockets at the bottom or lower portion to catch food rather than deflect it onto the wearer. Most of these types of bibs do not have a pleasant aesthetic appeal.

Bandanna bibs are typically merely scarves made of softer materials, such as cotton, that have been designed to be used as bibs to provide a more aesthetic appeal. These bibs can be worn all day rather than just at feeding times. However, bandanna bibs typically are not as efficient at protecting the wearer.

SUMMARY OF THE INVENTION

The present invention is a bib including an upper section with two arms, the two arms defining a neck opening. A lower section includes a protective portion. A first pleat extends across the width of the bib and is attached at the lateral edges of the bib. The top of the first pleat is attached to the upper section above the bottom of the neck opening. Preferably additional pleats, generally parallel to the first pleat, extend the width of the bib below and overlapping the first pleat. The pleats preferably have a scarf like appearance.

DESCRIPTION OF PREFERRED EMBODIMENTS

Figure 1:
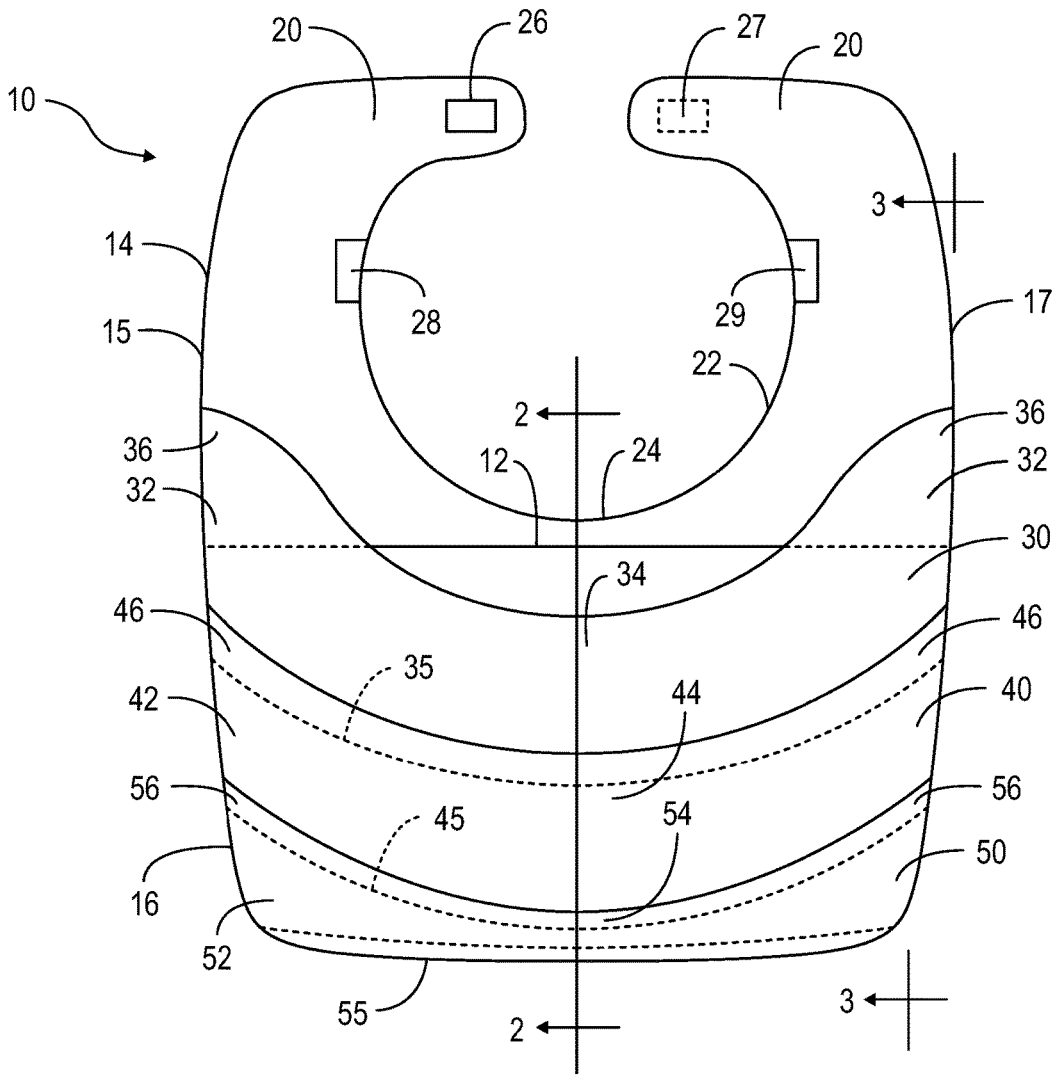
FIG. 1 is plan view of a bib of the present invention.
Figure 2:
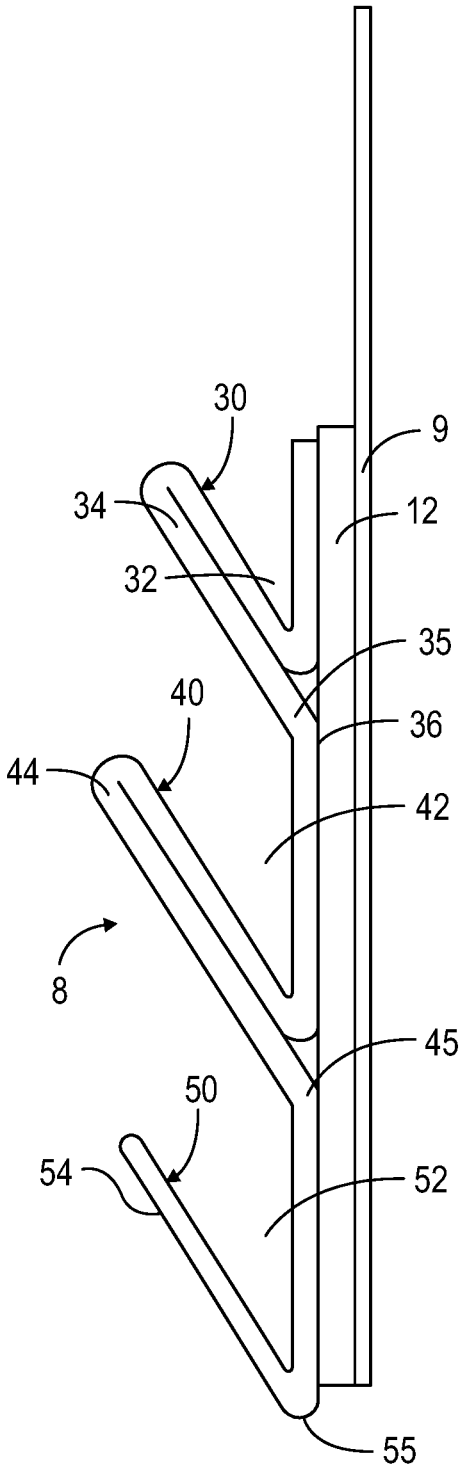
FIG. 2 is a cross-sectional view of the bib of FIG. 1 taken along line 2-2.
Figure 3:
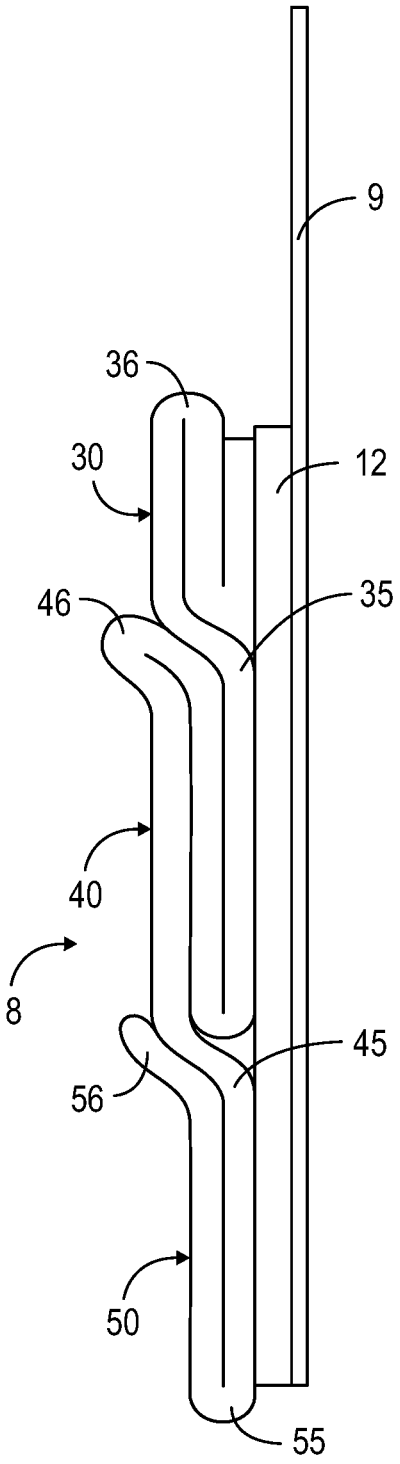
FIG. 3 is a cross-sectional view of the bib of FIG. 1 taken along line 3-3.

Referring to FIGS. 1, 2, and 3, the present invention is a bib 10 with pocket forming pleats and a scarf appearance. The scarf appearance allows the bib to be worn all day as a compliment to the wearer's clothing. The purpose of the pleats is to provide raised or open pockets or folds which are positioned below the wearer's chin and neckline to effectively catch food, spit-up, drool, etc.

The bib 10 has a liquid resistant or waterproof base sheet of material 9, preferably formed from a polyester or a polyurethane laminated knit fabric. A pleated top sheet of material 8, preferably formed from a soft absorbent fabric such as cotton, is attached to the base sheet 9. Preferably, the sheets 8 and 9 are attached by sewing, but other securing means can be used, such as adhesives. The base sheet 9 has an upper section 14 and a lower section 16. An optional middle sheet of absorbent material 12 is positioned in the lower section below the neckline.

The base sheet 9 has lateral edges 15 and 17. The upper section of the base sheet 9 is cut to form two arms 20 which define a neck opening 20. The neck opening has a lowermost portion 24. The two arms 22 are used to fasten the bib around a user's neck as will be described.

A typical length for the bib 10 from the lowermost portion 24 of the neck opening to the bottom of the bib is 4 to 6 inches, and preferably around 4.5 inches for a small child or infant. A typical width is from about 6 to about 7.5 inches. The bib 10 includes three deep pockets (32, 42, 52, FIG. 2) formed by pleats 30, 40, 50. The pleats, approximately 1-2 inches deep (height), are formed in the top pleat sheet 8 which is attached to the base sheet 9 at the lateral edges 15, 17 and the bottom of the base sheet 9 by sewing.

The pleats 30, 40, 50 are formed in the top sheet 8 by gathering the top sheet and folding it upward onto itself as can be seen in FIG. 2, forming overlapping pleats. The first or uppermost pleat 30 has lateral edges 32 and a center section 34. The lateral edges 32 are sewn or otherwise secured adjacent the lateral edges 15, 17 of the main body sheet. The top or upper corners 36 of the first pleat 30 are positioned above the lowest section 24 of the neck opening 22.

Referring to FIG. 2, the center portion 34 of the first pleat 30 is positioned below the neck opening 22 to provide a functional pocket. The center section 34 of the first pleat is open. In other words, the center section 34 is curved and extends away from the base sheet 9 to provide the pocket 32 and a scarf appearance. To achieve this structure, the center portion of each pleat is held open while the ends of the pleat are sewn into place so that the center portions remain open during use. One sewing technique which could be used is commonly called bending on the bias, as will be understood by those in the art. Similarly, the second and third pleats 40, 50 are formed by folding the top sheet 8 on itself and securing the top sheet edges to edges of the base sheet 9 such that the center portions 44, 54 are curved away from the base sheet 9 and remain open to provide pockets 42, 52 and a scarf-like appearance.

Referring to FIGS. 1 and 3, the upper corner 46 of the second pleat 40 is secured to the base sheet 9 at a position above the bottom 35 of the first pleat 30 to overlap with the first pleat. The upper corner 56 of the third or bottom pleat 50 extends from the bottom 55 of the bib, which is also the bottom of the third pleat 50, which may extend below the bottom of the base sheet 9. The top edge 56 of the bottom or third pleat 50 extends above the bottom 45 of the second or middle pleat 40.

Preferably, the lateral edges of each pleat 30, 40, 50 are sewn or other wise attached to the base sheet 9 in the same overlapping manner as previously described. Alternatively, the pleats may be spaced rather than overlapped, therefore adding more spacing between the pleats and pockets. Of course, any number of pleats and pockets may be used.

As described, the lateral ends 32 of pleat 30 are then sewn (overlapping or non-overlapping) to form a scarf-type pocket with an open or loose fitting center section 34, which also provides the decorative scarf-type appearance. Similarly, the lateral ends 42 of pleat 40, and then the lateral ends 52 of pleat 50, are attached to the lateral ends 15, 17 of the main sheet 12. The top corners 36, 46, 56 of each pleat may be attached by sewing or otherwise at a location slightly inwardly from the lateral edges 15, 17 to facilitate the opening of each pocket and the scarf appearance. Alternatively, the pleats and pockets can be formed from separate strips of material. In addition, a narrow binding (not shown) can be provided to cover the bib edges as is well known in the art.

Each arm 20 includes a fastener component 26, 27 for removably attaching the arms around the neck of a user. Preferably, the fastener components are hook and loop material components, snap components, a button and button hole, etc. as will be appreciated by those in the art. When used on infants and children, regular bibs tend to twist out of place or slide to either side of the child's body as the child plays and moves about. This defeats the purpose of the bib if the baby were to drool or spit up. To be effective, the bib should lie in front of and on the child's chest below the mouth. Magnetic, plastic or spring-type clip components 28, 29 may be provided for attaching the lateral sides of the arms to a user's clothing to prevent twisting of the bib away from a proper position below the user's neck. The clips allow the bib to stay in place regardless of a child's constant movement.

The descriptions of specific embodiments of the invention herein are intended to be illustrative and not restrictive. The invention may be practiced otherwise than as specifically explained and illustrated without departing from its spirit or scope as defined by the appended claims.

What is claimed is:

1. A bib comprising material having a centrally positioned neck opening, from a perspective of the bib being positioned vertically upright and fully extended, the neck opening having a lowermost portion, the material having two arm portions, each arm portion extending above the lowermost portion of the neck opening, a respective one of the two arm portions positioned on each side of the centrally positioned neck opening, and a first pleat extending from below the lowermost portion of the neck opening to above the lowermost portion of the neck opening, and a first open pocket formed by the first pleat, the first open pocket extending below the lowermost portion of the neck opening and opening upwardly toward the neck opening.

2. A bib as defined in claim 1 wherein the material comprises first and second lateral edges and wherein the first pleat extends from the first lateral edge to the second lateral edge.

3. A bib as defined in claim 2 further comprising a second pleat, wherein a portion of the first pleat is positioned between the lowermost portion of the neck opening and a portion of the second pleat.

4. A bib as defined in claim 3 wherein the second pleat extends from the first lateral edge to the second lateral edge.

5. A bib as defined in claim 3 wherein each of the first and second pleats has a top edge and a bottom edge, and wherein the top edge of the second pleat overlaps the bottom edge of the first pleat.

6. A bib as defined in claim 2 wherein the material comprises a base sheet and a top sheet attached to the base sheet, wherein the first pleat is formed from the top sheet, wherein the first pleat has a top edge, wherein the top edge of the first pleat is positioned (a) above the lowermost portion of the neck opening adjacent the lateral edges, and (b) below the lowermost portion of the neck opening between the lateral edges, whereby the top edge is curved.

7. A bib as defined in claim 6 wherein the top edge of the first pleat is bowed outwardly from the base sheet to form the pocket.

8. A bib as defined in claim 1 wherein the material comprises a base sheet and a top sheet, wherein the first pleat is formed from the top sheet.

9. A bib as defined in claim 8 wherein the top sheet is attached to the base sheet.

10. A bib as defined in claim 8 further comprising a middle sheet of absorbent material between the base sheet and the top sheet.

11. A bib as defined in claim 1 wherein one of the two arm portions includes a fastener.

12. A bib as defined in claim 11 wherein the fastener includes a magnet.

13. A bib as defined in claim 11 wherein the fastener includes hook and loop components.

14. A bib as defined in claim 11 wherein the fastener includes a clip, snap or button component.

15. A bib, from a perspective of the bib being positioned vertically upright and fully extended, the bib comprising:

(a) a base sheet of material, the base sheet of material having a first lateral edge, a second lateral edge and a neck opening positioned between the first and second lateral edges, the neck opening having a lowermost portion, (b) a top sheet of material attached to the base sheet of material, the top sheet of material having a first pleat, the first pleat having a top edge extending laterally from the first lateral edge of the base sheet of material above the lowermost portion of the neck opening to the second lateral edge of the base sheet of material above the lowermost portion of the neck opening, the first pleat top edge having a center portion between the lateral edges of the base sheet of material, wherein the top edge center portion of the first pleat is spaced from the base sheet of material to form an open pocket opening upwardly toward the neck opening.

16. A bib as defined in claim 15 wherein the top edge center portion of the first pleat is positioned completely below the neck opening.

17. A bib as defined in claim 15 wherein the top sheet of material further comprises a second pleat extending laterally from adjacent the first lateral edge of the base sheet of material to adjacent the second lateral edge of the base sheet of material, the second pleat having a center portion between the lateral edges of the base sheet of material, wherein the center portion of the second pleat is spaced outwardly from the base sheet of material.

18. A bib as defined in claim 17 wherein the second pleat is positioned to overlap with the first pleat.

19. A method of making the bib of claim 15, from the perspective of the bib being positioned vertically upright and fully extended, the method comprising the steps of:

providing the base sheet of material, the base sheet of material having upper and lower sections, forming the neck opening in the base sheet of material, providing the top sheet of material, the top sheet of material having an upper edge and lateral edges defining corners, attaching a corner of the top sheet of material to the base sheet of material at a location above the neck opening's lowermost portion, folding a first portion of the top sheet of material to form a first fold, attaching a lateral edge of the first fold to the base sheet of material at a location above the neck opening's lowermost portion to form the first pleat, folding a second portion of the top sheet of material to form a second fold, and attaching a lateral edge of the second fold to the base sheet of material to form a second pleat.

20. A method of making a bib as defined in claim 19, wherein a top of the second pleat is attached to the base sheet of material at a location above a bottom of the first pleat.

* * * * *